United States Patent [19]

Watkins et al.

[11] Patent Number: 4,735,513

[45] Date of Patent: Apr. 5, 1988

[54] FLEXIBLE PACKAGING SHEETS

[75] Inventors: James D. Watkins, Prior Lake; David W. Andreas, Minneapolis; David H. Cox, Robbinsdale, all of Minn.

[73] Assignee: Golden Valley Microwave Foods Inc., Edina, Minn.

[21] Appl. No.: 740,252

[22] Filed: Jun. 3, 1985

[51] Int. Cl.[4] ..... B65D 30/02

[52] U.S. Cl. ..... 383/116; 219/10.55 E; 383/113; 426/113; 426/127; 428/35; 428/209; 428/211; 428/457

[58] Field of Search ..... 428/36, 198, 201, 204, 428/206, 208, 209, 211, 283, 285, 286, 287, 329, 457, 458, 35; 426/127, 113; 383/113, 116; 206/524.9; 219/10.55 E

[56] References Cited

U.S. PATENT DOCUMENTS

| | | | |
|---|---|---|---|
| 2,830,162 | 4/1958 | Copson et al. | 219/10.55 E |
| 3,302,632 | 2/1967 | Fichtner | 219/10.55 E |
| 3,783,220 | 1/1974 | Tanizaki | 219/10.55 E |
| 3,835,280 | 9/1974 | Gades et al. | 219/10.55 E |
| 4,156,806 | 5/1979 | Teich et al. | 219/10.55 E |
| 4,158,760 | 6/1979 | Bowen et al. | 219/10.55 E |
| 4,166,208 | 8/1979 | Martel et al. | 219/10.55 E |
| 4,190,757 | 2/1980 | Turpin et al. | 219/10.55 E |
| 4,230,924 | 10/1980 | Brastad et al. | 219/10.55 E |
| 4,267,420 | 5/1981 | Brastad | 219/10.55 E |
| 4,390,588 | 6/1983 | Ebneth et al. | 428/288 |
| 4,398,994 | 8/1983 | Bechett | 156/635 |
| 4,450,180 | 5/1984 | Watkins | 426/107 |
| 4,548,826 | 10/1985 | Watkins | 426/394 |
| 4,553,010 | 11/1985 | Bohrer et al. | 219/10.55 E |
| 4,555,605 | 11/1985 | Brown et al. | 219/10.55 E |
| 4,641,005 | 2/1987 | Seiferth | 426/107 |
| 4,678,882 | 7/1987 | Bohrer et al. | 219/10.55 E |

FOREIGN PATENT DOCUMENTS 1153069 8/1983 Canada .

*Primary Examiner*—James J. Bell

*Attorney, Agent, or Firm*—James V. Harmon

[57] ABSTRACT

A flexible sheet structure is described which comprises a base sheet having a microwave coupling layer, e.g. electrodeposited aluminum as an island covering a selected area of the sheet. The uncoated portions will not be heated and will not be damaged by microwave energy. The selectively located microwave coupling covered area transfers absorbed heat to a product by thermal conduction. In one form of the invention a flexible fibrous backing sheet such as paper is bonded to the base sheet to provide dimensional stability and prevent warping, shriveling, melting or other damage during microwave heating.

23 Claims, 3 Drawing Sheets

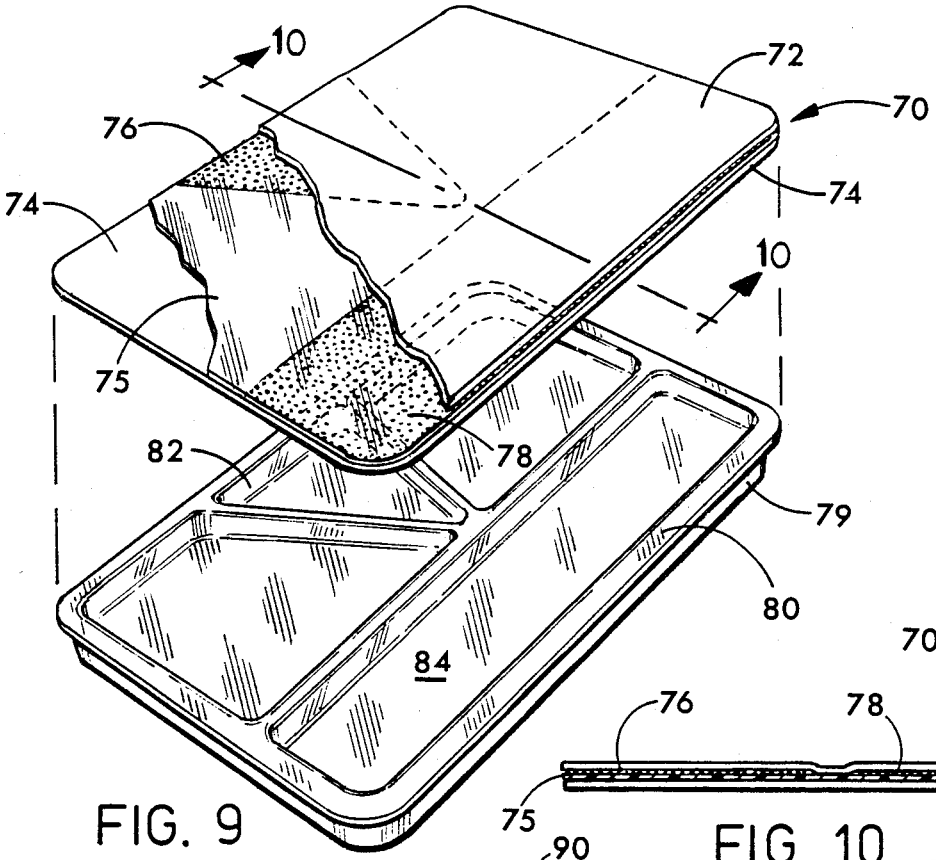
FIG. 9
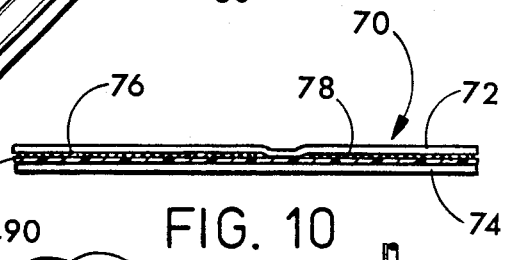
FIG. 10
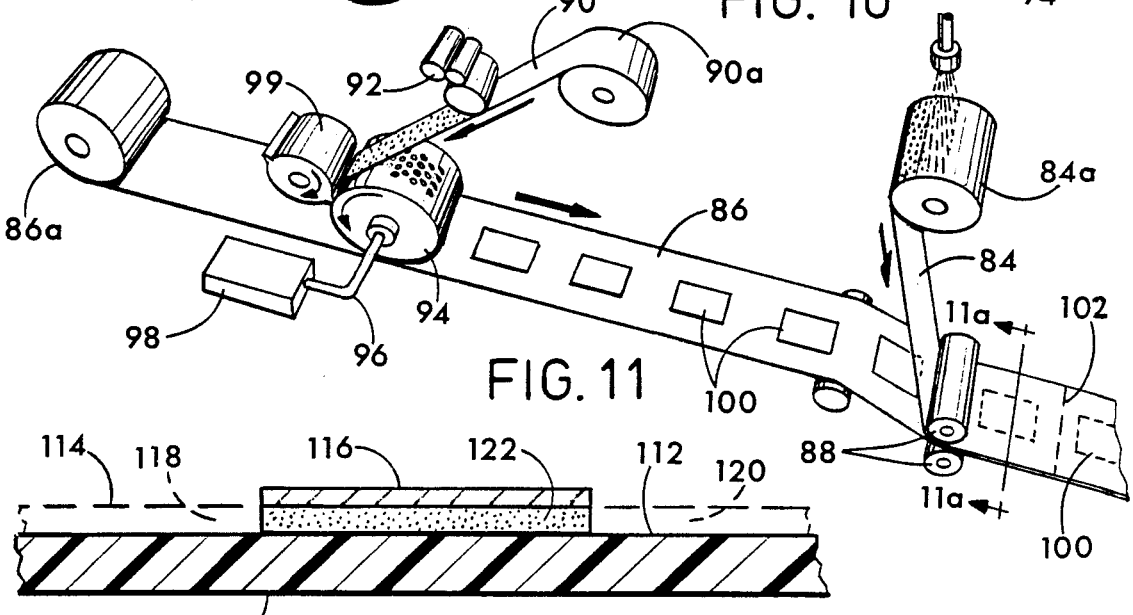
FIG. 11
FIG. 12

FLEXIBLE PACKAGING SHEETS

FIELD OF THE INVENTION

The present invention relates to packaging and more particularly to flexible packaging and to flexible laminates that are useful in packaging and shipping products.

BACKGROUND OF THE INVENTION

The present invention is concerned with the problem of providing a flexible packaging laminate which can be used in sheet form or in the form of a bag or other flexible container for heating articles in a microwave oven Many products have been proposed for browning, searing, or otherwise heating the surface of an article within a microwave oven. These prior products can be divided into three groups: rigid; semi-flexible or having limited flexibility; and flexible. Rigid heating containers are exemplified by the following U.S. Pat. Nos: 4,266,108; 4,184,061; 4,450,334; 4,398,077; 4,166,208; 4,158,760; and 4,320,274. Among these, U.S. Pat. No. 4,266,108 describes a reflective metal plate such as an aluminum plate to which a layer of lossy materials e.g. magnetic oxides known as ferrites have been applied. These materials are bonded to the reflectivetal plate which can be aluminium by means of an intermediate layer containing a binder on an air gap. U.S. Pat. No. 4,184,061 describes a glass ceramic browning vessel with a metalic oxide coating on its lower surface. U.S. Pat. No. 4,450,334 is similar, except that in this case a plastic layer containing a ferrite is applied to the bottom surface of an aluminum dish. In U.S. Pat. No. 4,398,077 a ceramic or glass dish is described having a resistive film 14 of tin oxide applied to its lower surface. Both of U.S. Pat. Nos. 4,166,208 and 4,158,760 describe conical containers formed from plastic. The lower end of each cone is in contact with the support member such as a block of plastic which is made lossy by the inclusion of metal or carbon particles. U.S. Pat. No. 4,320,274 describes a cooking utensil in the form of a dielectric dish, e.g., glass or plastic, having a metal layer extending through it.

Among references describing flexible packaging materials is U.S. Pat. No. 4,190,757, which describes a supporting substance in the form of aluminum foil which may be as little as one mil in thickness to which a paint-like layer of a ferrite or other lossy material is applied as a coating. For example, a wet mixture of taconite, sand, and sodium silicate are blended and applied by brushing and rolling the composition onto a sheet of three mil aluminum to a thickness of 0.03 inches. The resulting laminate is fairly thick (over 30 mils in thickness), and is difficult to handle with automated roll stands and other equipment used for winding, rolling, cutting, transferring and forming sheet material into packages. Moreover, the laminate is heavy and the ferrite coating sometimes tends to flake off when the underlying aluminum sheet is bent or flexed.

U.S. Pat. Nos. 4,267,420 and 4,230,924 describe thin flexible polyester films or laminates of polyester and polyethelene to which a thin semiconducting coating is applied. This coating is typically aluminum which is evaporated onto the plastic film. In developing the present invention, films of this kind were tested experimentally. However an important problem developed which rendered the patented sheets deficient in some applications. It was noted that a sheet or wrapper often extended away from the surface of the item being heated. The surface of the item being heated may also be irregular so that parts of the film do not conform to it. Moreover, the film often extended into portions of a package where the food product does not have access, e.g. bags or wrappers having a crimped end that did not contact the food. It was discovered that the portions which extended beyond the edges of the item being heated were especially subject to damage. Thus, after a few seconds of heating portions of the film shrank to $\frac{1}{3}$ of its original size or less and became melted in the process.

In one test, six cylindrical frozen fishsticks and six frozen chicken patties were each wrapped with a polyester film having a semiconducting evaporated aluminum coating of the type described in the Brastad patents. Each item was heated separately in a 625 watt Kenmore consumer type microwave oven. While a certain amount of surface crisping of the food did take place, the unsupported portions of the film that were not in direct contact with the food shriveled and disintegrated. Unless the film was pressed against the surface it would not remain intact. The portion of the sheet material between the food and the underlying dish remained in one piece, but the top and sides were particularly susceptible to damage. Especially where there were irregularities in the food, those portions of the film not in contact with the food would burn through. In the case of the chicken patties about 40% of the film disintegrated and became perforated with holes or otherwise melted, pulling back on itself as it shriveled up after 1.5 minutes of heating at which time the heating was discontinued. It was noticed that the patties were not completely heated and the film did not appear to produce surface browning of the food. Performance was judged unsatisfactory and commercially unacceptable. Moreover, the film did not pull away from the food in a predictable way so that the kind of design changes that might be needed to correct the problem were not apparent.

In view of these and other deficiencies in the prior art it is the general objective of the present invention to provide an improved flexible sheet for packaging purposes and for producing heat in a microwave oven with the following characteristics and advantages:

(a) the ability to absorb microwave energy and transfer the absorbed energy to products in a microwave oven during a heating process without shrinking, burning, shriveling or disintegrating, (b) the ability to perform satisfactorily although portions of the sheet extend away from and out of heat transfer relationship with the product being heated, (c) sufficient flexibility to be wound, unwound, transferred either as cut sheets or a continuous film or formed into package structures such as bags and the like on conventional processing and gluing equipment used for packaging films and paper, (d) the ability to carry out heating in certain selected areas and not in others, (e) the provision for handling and transferring a film capable of heating products as a continuous uninterrupted strip or web wherein only certain portions of the web perform a heating function, (f) the provision of cut-sheets of a microwave absorbing dimensionally unstable film are located at spaced locations and a provision is made for rendering them dimensionally stable and (g) the provision of areas of any selected shape such as rectangular, triangular, hexagonal, circular areas, etc. are capable of heating while other surrounding areas of a flexible sheet have no heating function.

These and other more detailed and specific objects and advantages of the invention will become apparent in view of the following detailed description and accompanying drawings which set forth by way of example certain illustrative embodiments of the invention.

THE FIGURES

FIG. 9 is a perspective view of another laminate embodying the invention which is illustrated for use as a flexible lid of a food heating tray.

FIG. 10 is a transverse sectional view of the laminate taken on line 10—10 of FIG. 9.

Figure 11A:
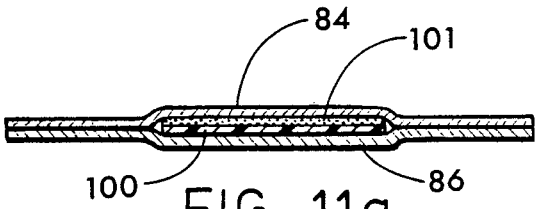
FIG. 11 is a perspective view illustrating a method for forming a laminate in accordance with another embodiment of the invention.

FIG. 11*a* is a sectional view on a larger scale taken on line 11*a*—11*a* of FIG. 11.

Figure 14:
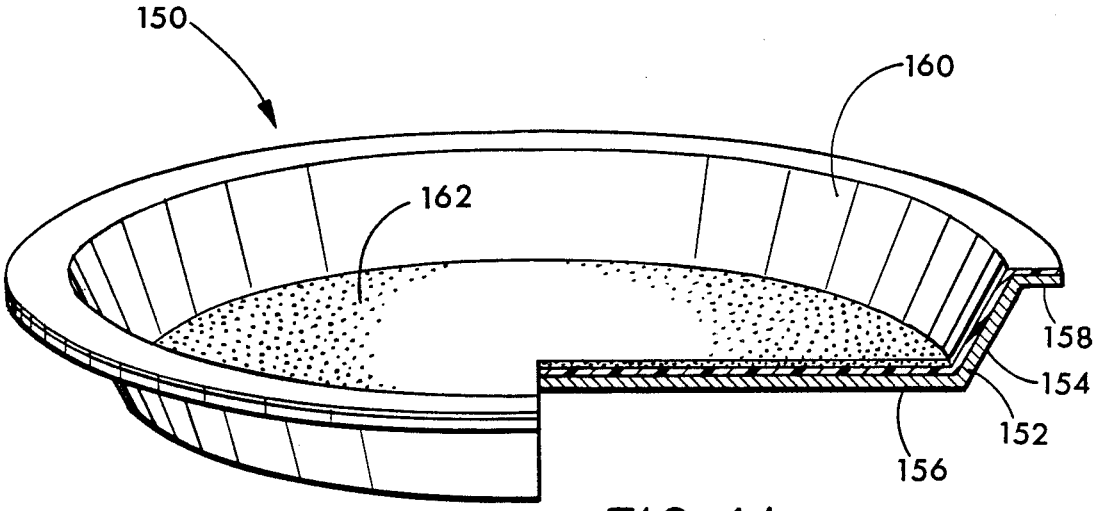
Figure 13:
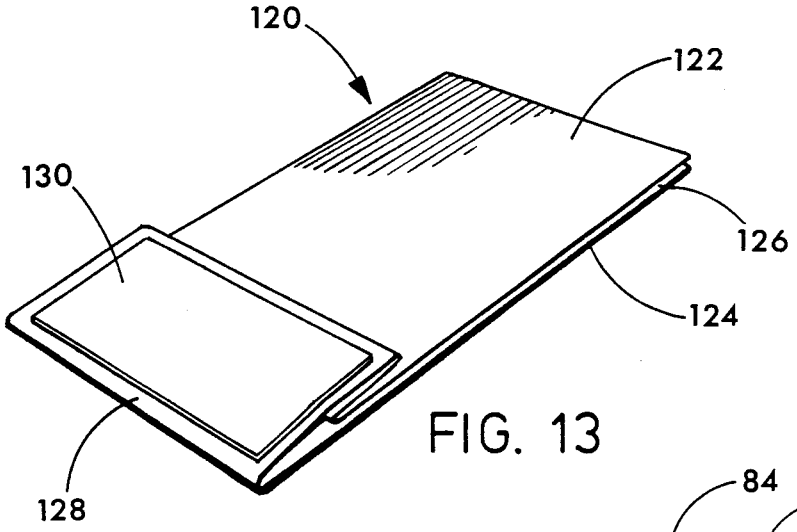

FIG. 12 is a semi-diagrammatic transverse sectional view illustrating a method of forming a laminate having islands of heat-absorbing materials surrounded by areas that do not become heated, FIG. 13 is a perspective view of a bag illustrating another application of the invention and FIG. 14 is a perspective view partly broken away of another embodiment.

SUMMARY OF THE INVENTION

Briefly, one form of the invention provides a flexible sheet structure formed from a base sheet composed of a microwave transparent flexible sheet upon which is located one or more islands of a selectively positioned coating of microwave coupling material which absorbs microwave energy and becomes hot when exposed to microwave energy. When applied to the surface of an article to be heated, the article will absorb heat by conduction from the sheet in selected areas where the layer of microwave coupling material is provided but the sheet will allow the product to heat by direct microwave exposure through the flexible sheet material in uncoated areas. The coupling layer can comprise a self-supporting sheet or film or it can comprise a coating applied from a fluid state such as a paint or lacquer or if desired a layer deposited by vacuum electrodeposition or electroplating.

More specifically, in one preferred embodiment of the invention the sheet structure comprises a laminate composed of a flexible backing sheet of dimensionally stable flexible material transparent to microwaves to which is applied a flexible base flexible sheet of non-dimensionally stable plastic resinous film having a coating of microwave-absorbing coupling material. In one preferred form of the invention the dimensionally stable backing sheet is a cellulosic material such as paper, cardboard, paperboard or synthetic sheet formed from synthetic plastic fibers of a non-thermoplastic and dimensionally stable composition. Other examples are non-thermoplastic thermoset polyamid fibers, melamine fibers and phenolic fibers. Primarily because of cost, at the present time paper is the most useful of the dimensionally stable backing sheets that can be used.

In a typical application of the invention, a plastic resinous base sheet having a microwave coupling coating such as a semiconductive metal coating is bonded for example by gluing to a dimensionally stable backing sheet composed of paper. In one preferred form of the invention the plastic sheet is the same size and shape as the paper while in another form of the invention the coated plastic sheet is smaller than the sheet of paper and its size and shape are carefully selected to produce special benefits. In another preferred form of the invention a single base sheet of flexible plastic is provided and on it is an island or area which covers only part of the base comprising a layer or coating of a microwave coupling substance adapted to absorb heat when exposed to microwave energy. The island or coated area may be of any selected shape, such as rectangular, triangular, circular, etc., but is usually the shape of the food product or other product to be heated. For example, if the product being heated is a hamburger patty, the island of microwave coupling material will have the shape and size of the hamburger patty and can be placed directly beneath it. The uncoated portions of the sheet can be folded up around the sides of the food or sealed to a similar sheet which lies in contact with the top surface of the food product. It was found that heat seals can be easily maintained since the uncoated laterally projecting sheet material does not absorb microwave energy which could melt or otherwise destroy a seal.

In another typical application of the invention, the microwave coupling material is applied to an underlying sheet of plastic resinous material which is laminated, i.e. bonded to an overlying sheet of paper. The microwave coupling coating may extend all the way to the edges of the paper or can be of a smaller size and of any selected shape, e.g., rectangular, circular, etc.

By contrast with the prior art, the sheet material of the present invention is surprisingly resistant to localized overheating, shriveling, melting or the formation of perforations. In a typical situation the sheet material of the present invention is placed around a food product such as a hamburger patty, french fries, etc., and is heated in a microwave oven for 4 to 6 minutes. After heating, the sheet material remains intact and is not deformed, melted or discolored. Moreover, heat is transferred very effectively to the food or other product and in spite of the high temperature reached, the paper is virtually never discolored, charred or otherwise damaged during the heating process. While the reason for this effectiveness is not known with certainty, it is believed to be primarily due to the greater mass of the paper and the fact that the paper was discovered to be dimensionally stable during heating.

Thus, the mechanical integrity of the paper is apparently effective in keeping the sheet in place. It is theorized that the greater mass of the paper to some extent acts as a heat sink for the heat generated in the microwave coupling material. It is also speculated that the large surface area of the paper sheet as seen under a microscope helps to radiate excess energy to thereby act as a moderating factor where the unsupported sheet material is not in contact with the article being heated and in that way prevents runaway heating which could damage the sheet. In the embodiments of the invention where the dimensionally stable fiber sheet is not used, the island of microwave coupling material should have the same size and shape as the food or other product being heated and be in contact with it more or less uniformly in order to prevent damage to the sheet due to overheating in localized areas.

DESCRIPTION OF THE PREFERRED EMBODIMENTS

Figure 1:
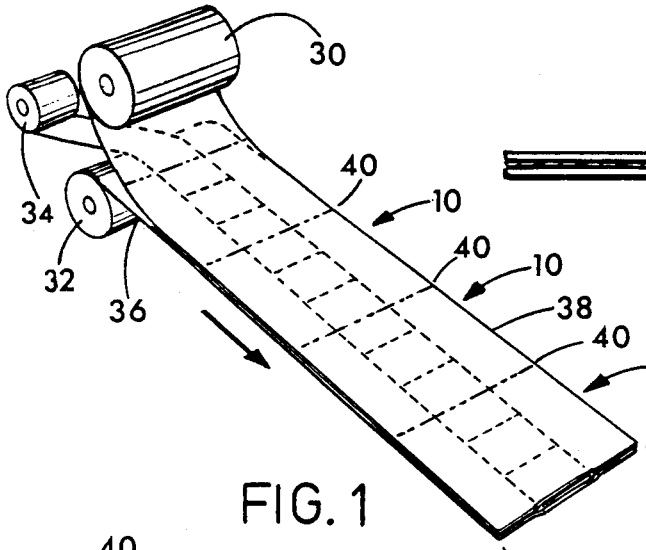
FIG. 1 is a diagrammatic perspective view illustrating a method of forming the laminate in accordance with one embodiment of the invention.
Figure 3:
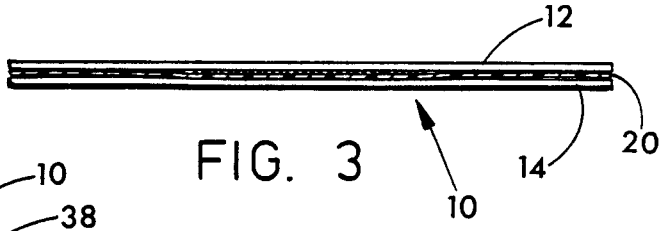
FIG. 3 is a transverse sectional view taken on line 3—3 of FIG. 2.

Refer now to FIGS. 1 through 5 which illustrate one embodiment of the invention and the method used for forming it. Shown in the Figures is a flexible laminated sheet 10 consisting of rectangular upper and lower backing sheets of layers 12 and 14 of bleached kraft paper; each having a 30 pound basis weight. The upper and lower sheets of kraft paper 12 and 14 are laminated together by adhesive or paste suitably applied at 16 and 18 to an intermediate relatively thin base sheet 20 such as a 1 mil thick film of a resinous plastic such as a polyester film of rectangular shape extending all the way from the front edge 22 of the laminate to the rear edge 24. Applied to the center portion of the sheet 20 is a thin coating 26 of microwave coupling heat-absorbing material of the type that becomes very not when heated in a microwave-oven. The coating 26 can comprise any of the well-known microwave coupling materials such as semiconductive metal coatings, ferrites, certain metal oxides such as iron oxide, and particularly magnetite all in powdered form, or coatings of the type described in the U.S. Pat. Nos. 4,267,420 and 4,230,924. When a metallic coating is used it is preferably applied by vacuum electrodeposition, and is semiconductive. The amount of metal applied during the electrodeposition process will control heating characteristics. As shown in FIG. 1, the laminate 10 can be formed by supplying the bleach kraft paper from two supply rolls 30 and 32 and the sheet 20 from a supply roll 34. The continuous strips of sheet material are brought together at 36 after adhesive is applied between the sheets by means of a suitable applicator (not shown) of any type known to those skilled in the art. The adhesive can be applied by spraying, brushing or by means of a roll-coater or the like. The strips from rolls 30, 32 and 34 are bonded together forming a web or strip 38 which travels from left to right in the Figure and is cut transversely at longitudinally spaced intervals indicated by dotted lines 40. It was discovered that the kraft paper sheets function as a dimensionally stable backing for the base film 20 laminated between them. All of the sheets 12, 14 and 20 are flexible and transparent to microwave energy. After the strip 38 has been cut at intervals designated 40, the sheet 10 will be of rectangular shape having front edge 22 or rear edge 24 side edges 23 and 25. The side edges of the sheet 20 are designated **20*a* and 20*b*. It can be seen that the front edge 20*c* and the ar edge 20*d* of sheet 20 are ligned with the front and rear edges of the complete sheet 10**.

Figure 4:
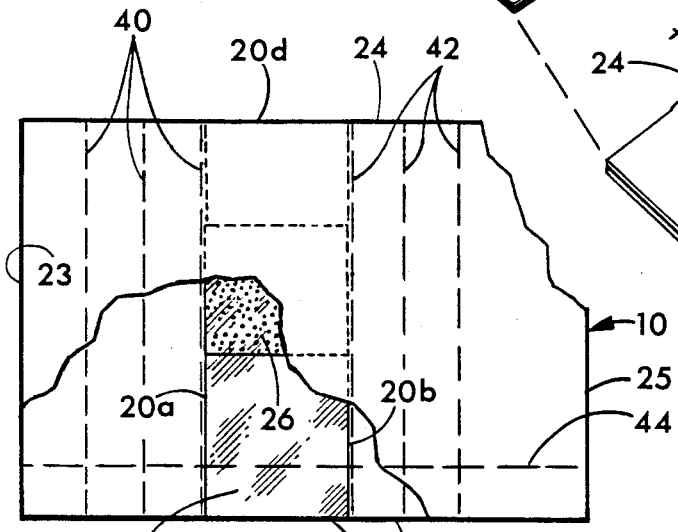
FIG. 4 is a plan view of a laminate in accordance with the present invention suitable for use in making a bag.
Figure 5:
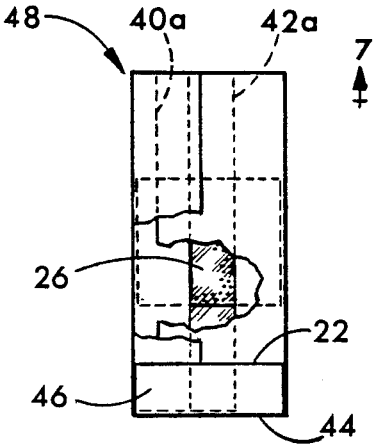
FIG. 5 is a bag formed from the laminated FIG. 4 on a somewhat reduced scale.

A laminate and other sheet material made in accordance with the invention has many applications. For example, it can be used as a tray-liner, i.e. in flat sheet form to line a paperboard tray or other container, or if desired can be layered between objects that are to be heated in a microwave oven. It can also be used as a wrapper, in which case the portions of the sheet that extend beyond the edges of the microwave coupling material 26 absorb no heat can be wrapped or folded around the product that is to be heated. For example, as shown in FIGS. 4 and 5 and sheet 10 can be provided with three left longitudinally extending fold lines 40 and three right longitudinally extending fold lines 42. When the sheet is folded along the fold lines 40 and 42 the edges 23 and 25 can be brought together in an overlapping relationship and sealed to each other by means of a suitable adhesive. The folds along the left fold line 40 define a left gusset as shown in FIG. 5 designated **40*a* and fold lines 42 define a right gusset 42*a*. A transversely extending bottom fold is provided at 44 and it is along this line that the bottom portion of the sheet can be folded upwardly and bonded to the underlying sheet material to form a bottom seal or closure 46. In this way, the sheet material 10 of the present invention is formed into a flexible paper bag that has a centrally located rectangular heat-absorbing area 26**.

The laminate illustrated in FIGS. 1 through 5 provides excellent heating results either in flat sheet form as a wrapper or formed into a bag as shown in FIGS. 4 and 5. It is not subject to damage during the heating cycle. Even areas not in contact with the food will not be damaged. It appears critical that the film supporting the microwave coupling coating be bonded securely to the dimensionally stable base sheets 12 and 14. It was found that if portions of the sheet 20 become loosened from the sheet 12 or 14 they will become subject to runaway heating and damage. It is preferred to have the coated sheet 20 trapped between two layers of paper but this is not essential. In some applications where the product to be heated has a smooth surface and is fairly large in mass, a single layer of paper 12 is satisfactory and layer 14 can be eliminated. A layer of paper will also keep food away from the metal coating 26 which is desirable in some applications. It was surprising to find that in spite of the heat insulating qualities of the paper, the heat within the sheet 20 which may be reach 600 F. was readily conducted through the paper layer 12 to the food or other product being heated. It was found that a pair of paper sheets 12 and 14 provide a stronger support structure and maintain package dimensions better, i.e. prevent the sheet material from curling or bending. In addition, a pair of paper sheets as shown makes the laminate more tolerant with respect to the kinds of adhesive that will work for forming the laminate because it is more difficult to reliably bond the coated plastic sheet to a single sheet of paper than to two sheets. This advantage of having two stabilizing backing sheets is important since the metal coated film will shrink or melt wherever it separates from the underlying paper sheet. For these three reasons the pair of backing sheets one on each side of the microwave coupling sheet 20 is preferred to a single sheet of paper 12. Other suitable backing sheets will be apparent to those skilled in the art. The laminate described in FIGS. 1 through 5 has proved effective in heating products faster than without such a sheet and with some products can provide surface browning or crisping.

Figure 2:
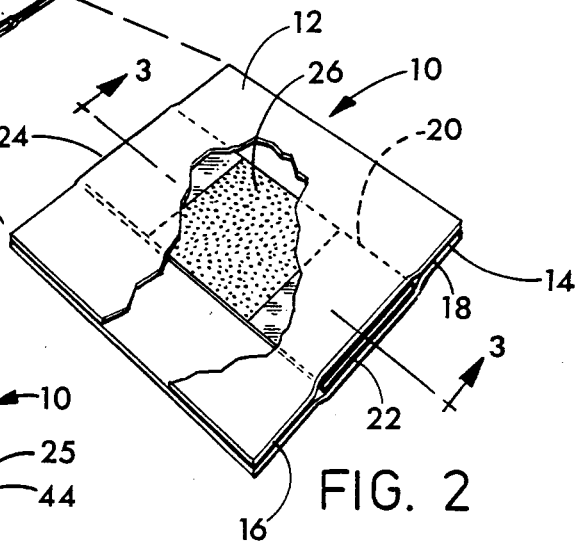
FIG. 2 is a perspective view on a larger scale of a cut sheet of a flexible laminated structure formed as shown in FIG. 1.

Typical foods for which the invention is suited include popcorn, hamburger, french fries and pizza. It can also be used for heating battered or breaded food products such as breaded chicken, prepared waffles, etc. In the case of popcorn, the laminate can be formed into a bag. With the other three foods the laminate can be used in flat sheet form as shown in FIG. 2. If layer 26 is a metal, it is preferably aluminum but other metals such as stainless steel, copper, gold and the like can be used. It is preferred that the metal layer 26 if formed of aluminum transmit approximately 40 to 60% of the incident light. If over 60% is transmitted heating is generally too slow to be of value. If below 40% electrical discharges begin to occur in the sheet which begins to burn the film 40. While 0.5 mil polyester film has been found satisfactory as a base for supporting the microwave coupling layer, the base film can be composed of other materials such as a polycarbonate or polyamid resin. One suitable adhesive is a thermosetting polyvinyl acetate emulsion adhesive. Other polyvinyl acetate resin based emulsion adhesives are also suitable.

The invention as disclosed in FIGS. 1 through 5 provides a three-ply laminate having a microwave coupling heat absorbing layer in selected areas lacking such a coating in other areas. The dimensional stability added by the backing sheet keeps the coupling sheet from shrinking, warping or melting and also helps to keep the laminate in contact with the greater mass of the product being heated which serves as a heat sink to keep the temperature of the laminate under control.

Figure 6:
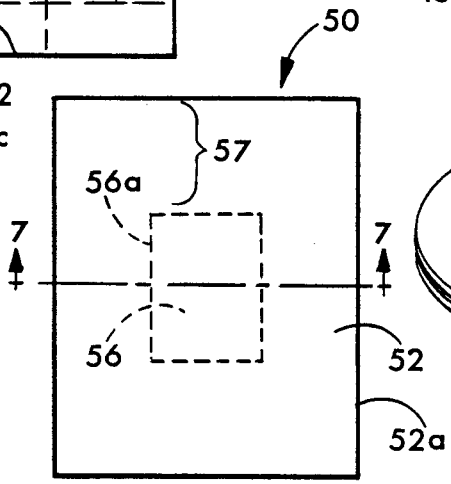
FIG. 6 is a plan view of another form of flexible laminate in accordance with the invention.
Figure 7:
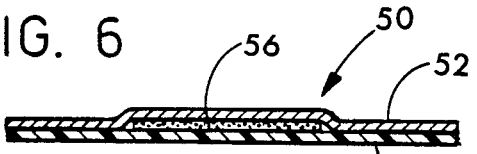
FIG. 7 is a transverse sectional view taken on line 7—7 of FIG. 6.

Refer now to FIGS. 6 and 7 which illustrate a laminate 50 in the form of a composite flexible rectangular sheet of paper 52 bonded by means of a suitable adhesive to an underlying layer of plastic film 54 of the same size and shape. Any suitable adhesive can be used such as a resin emulsion type adhesive. Deposited on the surface of the film 54 is a layer or coating of a microwave coupling substance which will become very hot when subjected to microwave heating. Any of the above-mentioned materials will be satisfactory. Electrodeposited metal is the most preferred.

It will be seen that the coating 56 has a peripheral edge 56*a*, in this case of rectangular shape, which is spaced inwardly a substantial distance from the periphery 52*a* of the laminate 50. In this way the laminate 50 is provided with the microwave coupling material in a selected area, while other areas, namely the space 57 between the coating 56 and the edge 52*a* are uncoated and will not become heated when placed in a microwave oven. Consequently even if these areas are out of contact with the food or other product to be heated they will not become scorched, burned, shrunken or otherwise damaged.

Figure 8:
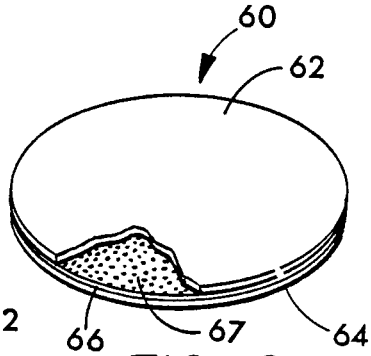
FIG. 8 is a perspective view of another form of laminate in accordance with the invention.

Refer now to FIG. 8 which illustrates another embodiment of the invention. Shown in FIG. 8 is a flexible laminate 60 of circular shape comprising an upper and lower paper sheets 62 and 64 of the same size and shape bonded by means of a suitable adhesive to an intermediate plastic film layer 66. On the upper surface of layer 66 is coated a microwave coupling material 67 that will become hot in a microwave oven. It can be seen that in this case the coupling material 67 extends all the way to the edges of the sheet 60 rather than covering a selected fractional area of the sheet 60. This laminate can be used for a variety of purposes, but is preferably cut to the same shape of the object being heated so that its edges do not extend laterally beyond it. For example if the sheet 60 is to be used for heating a hamburger patty, the sheet 60 should be of approximately the same shape and size or slightly smaller. The hamburger patty can be pressed to the top of such a sheet or pressed between a pair of such sheets prior to microwave heating. During microwave heating, the contacting surfaces of the patty will be heated by conduction from the sheet 60 and will become much hotter than the other surface. Sheet 60 will also sear or brown the surfaces in contact with it.

The sheet 60 can also be used as a liner for the bottom of a plastic T.V. dinner tray or as a liner for the bottom and top if desired of a package of french fried potatoes. In a preferred form of the embodiment shown in the FIG. 8, the laminate consists of upper and lower sheets composed of machine glazed kraft paper having a basis weight of 25 to 50 pounds per ream. The base 66 can comprise 0.5 mil polyester film with aluminum 67 electrodeposited in sufficient quantity to transmit about 45 to 55 percent of the incident light. One or both of the kraft layers 62 or 64 can be composed of grease-proof kraft paper or grease stain resistant kraft paper which is available commercially.

Refer now to FIGS. 9 and 10 which illustrate another embodiment of the invention wherein the microwave coupling layer has a selected pattern covering an area smaller than the overall size of the sheet. In FIGS. 9 and 10 a flexible laminate 70 the thickness of which has been exaggerated for purposes of illustration, comprises upper and lower dimensionally stabilizing paper layers 72 and 74 with an intermediate layer of plastic film such as 1 mil polyester film 75 to which is applied a triangular coating of microwave coupling material 76 on one side of a sheet and a rectangular area of a similar material 78 on the other side. The flexible laminate 70 is composed of the same materials used in connection with the embodiments already described. Bonding is accomplished with any suitable adhesive. The laminate 70 can be used as a removable cover for a plastic ready-to-heat dinner tray 79 and is sealed around the entire upper edge thereof at 80. The triangular and rectangular areas 76 and 78 are above tray compartments 82 and 84 and will heat the surfaces of the food contained in them to a much higher temperature than in the other compartments of the tray. In this way the surfaces of the food, e.g. a steak or potato product can be seared or crisped.

Refer now to FIG. 11 which illustrates a method of forming another kind of laminate in accordance with the invention. As shown in the Figures a pair of paper webs 84 and 86 travelling in given feed directions from supply rolls 84*a* and 86*a* are brought together between the nip of a roll pair 88. An intermediate layer of plastic film 90 which is coated with a microwave coupling coating of the type described above is supplied from roll 90*a*. The coating can be any of the types described above. As the strip of film 90 travels downwardly, adhesive is applied from supply roll 92. The film then travels over a rotating vacuum roll 94 having perforations in its surface that communicate through a pipe 96 with a vacuum pump 98 to retain the film 90 on its surface as it passes a transverse cutting roll 99 which severs the film 90 at spaced intervals into separate sheets 100 which are brought down into contact with the upper surface of the web 86 and are deposited at spaced apart points owing to the relatively slower speed of the strip 90 and roll 94. In this way the sheets 100 will be bonded between the web 84 and 86 and consequently can be spaced apart from its edges. The resulting laminate can be cut apart along transverse lines 102 between the sheets 100. As shown in FIG. 11*a* the cut sheets 100 are provided on their upper surface with a semiconductive microwave coupling coating layer 101. The film 100 is stabilized by the overlying dimensionally stabilizing paper sheets 84 and 86.

Refer now to FIG. 12 which illustrates a coated film in accordance with the invention and method for forming it. As shown in the Figures a backing sheet such as a 0.5 to 3.0 mil flexible polyester film 110 is initially coated on its entire upper surface 112 with a layer 114 of a microwave coupling material having any of the compositions described herein. Over the coupling material is applied a protective varnish 160 covering an area of a selected size and shape which is smaller than that of the backing sheet 110. For example, the varnish 116 may have triangular or rectangular shapes such as the pattern shown at 76 and 78 of FIG. 9, or of any other shape and repeat pattern along the length of a continuous web. Following the application of varnish 116, the laminate is exposed to a caustic bath to dissolve away the material at 118 and 120 and leave an island 122 of microwave coupling material of the desired pattern that is protected from the caustic bath by the varnish 116. This method can be referred to as pattern demetalization.

Refer now to FIG. 13 which illustrates another method of employing laminates in accordance with the invention. Shown in the Figures is a flexible paper bag 120 formed from kraft paper and having front and rear panels 122 and 124, side gussets only the one designated 26 being visible, and a bottom wall 128. To the bottom wall 128 is pasted or otherwise adhesively bonded a sheet 130 of substantially the same shape as the bottom wall 128. The sheet 130 has the same composition and structure as either of the laminates 50 or 60. If of the type shown in FIG. 6, the border portion 57 that does not become heated should be made smaller or eliminated. If the laminate 60 is used, it should be cut to rectangular shape to fit the bottom panel 128. The stabilizing paper layer used in the laminate 130 has important benefits. It helps the coated plastic film retain its dimensional stability and aids in bonding the laminate reliably to the underlying sheet material of the bag 120. In this way the chance for damage to the laminate caused by overheating is minimized and all parts of the laminate can be reliably bonded to the bag.

In FIG. 14 is illustrated a paper dish 150 that is pressed into a dish shape between a pair of mating forming dies. The dish has a side wall 154 and bottom wall 156 in this case of circular shape, and a rim 158. To the upper surface of the dish is bonded a polyester film 160 which because of its very light weight takes on the same shape as the paper tray 150. At the center only of the polyester film is a coating 162 of a microwave coupling material in any of the compositions already described. It will be noted that only a selected portion of the dish and the underlying carrier film 160 are coated. As a result heating will be localized in a specific selected area in this case the bottom wall of the dish 150. Again, the dimensionally stable paper backing 152 acts as a support for maintaining the coupling material 162 in place and for preventing overheating or melting.

Many variations of the invention will be apparent to those skilled in the art within the scope of the appended claims once the principles described herein are understood.

What is claimed is:

1. A flexible sheet structure comprising a base sheet composed of microwave transparent flexible sheet material, a thin layer microwave cqupling material as an island which becomes hot when exposed to microwave energy, said layer being selectively positioned on a portion of the base sheet to achieve heating of a product that is to be heated through conductive heating from the layer of microwave coupling material in the selected area where the coupling layer is located and other portions of the base sheet remaining unheated when exposed to microwave energy.

2. The flexible sheet structure of claim 1 wherein the base sheet is a plastic resinous film and the microwave coupline layer is a semiconductive metallic film applied to one surface of the base sheet.

3. The flexible sheet structure of claim 1 wherein the unheated portions of the base sheet are adapted to be folded, tucked and wrapped around said product and upon exposure to microwave energy the sheet will be free from damage due to shrinking, shriveling, warping or melting whether loose and unsupported or part of a seal.

4. The flexible sheet structure of claim 1 wherein a dimensionally stable flexible backing sheet composed of non-thermoplastic fibers is laminated to the base sheet at least in the area of the microwave coupling layer to assist in preserving the integrity, dimensions and shape of the base sheet when exposed to microwave energy.

5. The flexible sheet structure of claim 4 wherein the backing sheet comprises a sheet of paper.

6. The laminate of claim 4 wherein the backing sheet comprises a synthetic sheet material formed from non-thermoplastic resinous fibers bonded together at their points of contact.

7. The flexible sheet structure of claim 1 wherein a layer of paper is bonded to both the top and bottom surface of said base sheet to provide dimensional stability and thereby assist in preserving the integrity, shape and dimensions of the base sheet.

8. A laminate suited for wrapping, packaging and shipping articles comprising a backing composed of a flexible sheet of dimensionally stable fibrous organic non-thermoplastic material transparent to microwave energy and a base sheet bonded thereto of dimensionally unstable plastic film and a layer of microwave coupling material which becomes hot in a microwave oven when exposed to microwave energy and said backing sheet preserving the integrity, shape and dimensions of the base sheet and the coupling layer.

9. The laminate of claim 8 wherein the backing comprises paper and the coupling layer is applied as a coating to the base sheet.

10. The laminate of claim 8 wherein the coupling layer comprises a semiconductive layer of metal electrodeposited upon the base sheet to a thickness permitting 40% to 60% light transmission.

11. The laminate of claim 8 wherein said laminate is folded into bag form and sealed to itself to provide a bag structure.

12. The laminate of claim 8 wherein said microwave coupling material comprises an island of said coupling material extending across a selected portion of the laminate and other portions of the laminate are free from said coupling material thereby remaining unheated when exposed to microwave energy.

13. The laminate of claim 8 wherein said coating of microwave coupling material is a semiconductive metal coating covered by a masking layer and said island is formed by a pattern demetalization wherein said laminate is exposed to a caustic bath to remove said semiconductive metal except where protected by the masking layer.

14. The laminate of claim 8 wherein said backing sheet comprises a sheet of stiff paper and said laminate is folded by the application of pressure to the form of a self-supporting dish.

15. A flexible laminate including at least three layers suited for wrapping, packaging and shipping food articles that are to be heated in a microwave oven comprising a base sheet composed of microwave transparent flexible sheet material coated on at least one surface thereof with a layer of microwave interactive coupling material which becomes hot when exposed to microwave energy and being susceptible to melting, shrinking, warping and/or sriveling when exposed to microwave energy, said base sheet being positioned on a selected portion of the laminate to achieve heating of said food product through conduction of heat from the layer of microwave interactive coupling material to the food product in a selected area where the coupling material is located while other portion of the laminate remain unheated when exposed to microwave energy, and two layers of dimensionally stable flexible backing sheet material, one such backing sheet being bonded to each side of the base sheet to form a sandwich structure in which the base sheet is encapsulated and dimensionally stabilized by the enclosing flexible backing sheets on each side thereof, said backing sheets being composed of non-thermoplastic fibers that assist in preserving the integrity, dimensions and shape of the base sheet when the base sheet is exposed to microwave energy and heat being transferred from the base sheet through one of the dimensionally stable fibrous backing sheets to the food product by thermal conduction without disturbing the fibrous structure thereof.

16. The flexible sheet structure of claim 15 wherein said backing sheets comprise a layer of paper bonded to the top and bottom surfaces of the base sheet to provide dimensional stability.

17. The laminate of claim 16 wherein said laminate is formed into a bag structure including a pair of opposed bag face panels, interconnecting gusset panels, said bag having upper and lower ends and being sealed along at least one end thereof to provide a bottom seal for the bag and said microwave interactive coupling sheet material is positioned to occupy a portion of one of said bag faces to absorb microwave energy and to convert the microwave energy to heat within the base sheet and to transfer the heat from the bag sheet through one of the backing sheets to a food article resting thereon and the encapsulation of the base sheet between the backing sheets on each side thereof being adapted to preserve the integraity, shape and dimensions of the bag during microwave heating while heat is tranferred from the interactive layer through the overlying paper backing sheet into said food article resting thereon.

18. The article of claim 16 wherein said laminate is formed into a bag composed of flexible sheet material transparent to microwave energy and includng two opposed face panels having transversely extending upper and lower edges and a pair of longitudinally extending side edges, sections of interconnecting folded sheet material defining centrally projecting gussets extend between the side edges of the face panels to allow the bag to expand as the food is heated, one face panel of the bag defines a lower wall adapted to be placed downwardly during microwave heating, said microwave interactive material and said base sheet being encapsulated within said lower wall, portions of the bag remote from the food article being free from microwave interactive material thereby absorbing no microwave energy during heating in a microwave oven.

19. The article of claim 18 wherein the bsae sheet comprises a thin flexible polyester film, the microwave interactive material comprises a semiconductive vacuum metallized metallic layer on said polyester film and the backing sheets comprise layers of paper bonded to both surfaces of the base sheet to encapsulate the microwave interactive material.

20. The article of claim 19 wherein the vacuum metallized layer is transparent to light to a degree permitting between about 40–60% light transmission.

21. A flexible laminate to be used in a packaging container for food articles that are to be heated in a microwave oven, said laminate comprising, (1) an enclosed layer of microwave interactive coupling material comprising a lossy composition which becomes hot anmd is itself susceptible to scorching or shriveling when exposed to microwave energy in a microwave oven, (2) said interactive layer being positioned within a selected part of the laminate to achieve heating of the food product through conduction of heat from the layer of microwave interactive coupling material to the food product in a selected area where the coupling material is located while other portions of the laminate remain unheated when exposed to microwave energy, (3) said laminate being formed into a container having a top and a bottom and side walls and said and said interactive layer being incorporated into one wall of the container adapted to support the food product during heating whereby the food product rests upon the laminate above the interactive layer in a heat conductive relationshop therewith, (4) a backing layer of flexible sheet material bonded to each side of the microwave interactive layer to form a sandwich structure in which the microwave interactive layer is encapsulated and dimensionally stabilized by the enclosing flexible backing sheets on each side thereof, (5) said backing sheets being composed of microwave transparent sheet material wherein at least one of the backing sheets is composed of nonthermoplastic fibers that assist in preserving the integrity, dimensions and shape of the microwave interactive layer when the laminate is exposed to microwave energy and (6) whereby during heating in a microwave oven, heat is transferred from the microwave interactive layer through one of the backing sheets to the food product by thermal conduction to thereby carry heat into the surface of the food from the interactive layer without damaging portions of the sheet material remote from the food.

22. The laminate of claim 21 wherein said laminate is formed into a package comprising a bag and the fibrous sheet comprises paper folded into bag form.

23. The laminate of claim 21 wherein the laminate is mounted upon a package as a lid therefor.

* * * * *

UNITED STATES PATENT AND TRADEMARK OFFICE

CERTIFICATE OF CORRECTION

PATENT NO. : 4,735,513

DATED : April 5, 1988

INVENTOR(S) : J. D. Watkins, et al

It is certified that error appears in the above-identified patent and that said Letters Patent is hereby corrected as shown below:

Column 5, line 66, change "ar" to --- rear ---. Line 67, change "ligned" to --- aligned ---.

Column 9, line 68, correct the spelling of "coupling".

Column 10, line 64, change "8" to --- 12 ---.

Column 11, line 49, change "bag" to --- base ---.

Column 12, line 7, correct the spelling of the word "base". Line 23, correct the spelling of the word "and". Line 35, at the end of the line, cancel the words "and said" which appear twice.

Signed and Sealed this

Eighteenth Day of October, 1988

*Attest:*

DONALD J. QUIGG

*Attesting Officer*

*Commissioner of Patents and Trademarks*